US009077129B1

(12) United States Patent
Welch

(10) Patent No.: US 9,077,129 B1
(45) Date of Patent: Jul. 7, 2015

(54) POWER SUPPLY STRIP WITH REPOSITIONABLE OUTLETS

(71) Applicant: Robert E. Welch, Wilmington, MA (US)

(72) Inventor: Robert E. Welch, Wilmington, MA (US)

( * ) Notice: Subject to any disclaimer, the term of this patent is extended or adjusted under 35 U.S.C. 154(b) by 0 days.

(21) Appl. No.: 14/552,318

(22) Filed: Nov. 24, 2014

Related U.S. Application Data

(60) Provisional application No. 61/974,955, filed on Apr. 3, 2014.

(51) Int. Cl.
*H01R 25/00* (2006.01)
*H01R 25/14* (2006.01)

(52) U.S. Cl.
CPC ..... *H01R 25/006* (2013.01); *H01R 25/14* (2013.01); *H01R 25/142* (2013.01)

(58) Field of Classification Search
CPC ..... H01R 25/14; H01R 25/142; H01R 25/16; H01R 25/161
USPC ..... 439/10, 94, 110, 114, 116, 118, 119, 439/121, 535, 649, 660
See application file for complete search history.

(56) References Cited

U.S. PATENT DOCUMENTS

| | | | | |
|---|---|---|---|---|
| 1,964,042 | A | 6/1934 | Du Bois et al. | |
| 2,254,280 | A | 9/1941 | Gottheimer | |
| 2,310,024 | A | 2/1943 | Frank et al. | |
| 2,361,537 | A | 10/1944 | Frank | |
| 2,611,801 | A | 9/1952 | Hammerly et al. | |
| 4,003,618 | A | 1/1977 | Booty | |
| 5,162,616 | A * | 11/1992 | Swaffield et al. | 174/99 B |
| 5,618,192 | A | 4/1997 | Drury | |
| 5,759,051 | A * | 6/1998 | Cancellieri et al. | 439/118 |
| 6,644,988 | B2 | 11/2003 | Healy | |
| 7,258,555 | B2 * | 8/2007 | Tiesler et al. | 439/121 |
| 7,824,185 | B2 * | 11/2010 | Chien | 439/11 |
| 8,118,606 | B2 * | 2/2012 | Larsson | 439/110 |
| 2013/0225012 | A1 * | 8/2013 | Leng et al. | 439/716 |

FOREIGN PATENT DOCUMENTS

GB 2067363 A 7/1981

* cited by examiner

*Primary Examiner* — Vanessa Girardi
(74) *Attorney, Agent, or Firm* — Richard C Litman

(57) ABSTRACT

The power supply strip with repositionable outlets includes an elongated housing defining the strip. The housing has a front face defining an elongated rectangular slot. An elongated power bus bar, an elongated neutral bus bar, and an elongated ground bus bar extend the length of the housing in compartments above, below, and in rear of the slot, respectively. The strip is used with adapter plugs having an L-shaped power prong, an L-shaped neutral prong stepped back from the power prong, and a cylindrical ground prong. The prongs are inserted through the slot, the adapter plug is rotated 90° to align the prongs with the bus bars, and the adapter plug is drawn forward to engage the prongs with the bus bars. The adapter plug may be attached directly to an appliance cord, or the adapter plug may have a three-prong receptacle opposite the prongs.

20 Claims, 8 Drawing Sheets

POWER SUPPLY STRIP WITH REPOSITIONABLE OUTLETS

CROSS-REFERENCE TO RELATED APPLICATION

This application claims the benefit of U.S. Provisional Patent Application Ser. No. 61/974,955, filed Apr. 3, 2014.

BACKGROUND OF THE INVENTION

1. Field of the Invention

The present invention relates to electrical outlets, and particularly to a power supply strip with repositionable outlets that permits plugging an electrical appliance into electrical power at any desired location along an elongated power supply strip, effectively providing a repositionable electrical outlet.

2. Description of the Related Art

Modern houses, offices and the like are typically provided with a fixed number of electrical outlets, typically mounted in the walls or baseboards, or above the top of a workbench in a shop or laboratory. The location of the electrical outlets is typically based upon access to electrical junction boxes during the construction process, often resulting in the outlets being inconveniently positioned for the needs of the end user. In addition to such inconvenience, plugs for appliances or the like may be provided with three prongs (i.e., a third prong being provided as an electrical ground), and the outlet may only provide receptacles for two-prong plugs. Although adapters are available that will permit using a three-prong plug with a two-prong receptacle, this is usually discouraged by the manufacturer of the appliance, since it leaves the appliance without a connection to ground, which is usually recommended for safety. Also, the polarity of the outlet (i.e., the design of the outlet that accepts plugs having different size prongs to assure that power is connected only to a specific prong) is required for some appliances. Thus, a power supply strip with repositionable outlets solving the aforementioned problems is desired.

SUMMARY OF THE INVENTION

The power supply strip with repositionable outlets includes an elongated housing defining the strip. The housing has a front face defining an elongated rectangular slot. An elongated power bus bar, an elongated neutral bus bar, and an elongated ground bus bar extend the length of the housing in compartments above, below, and in rear of the slot, respectively. The bus bars are connected to the alternating current (AC) power mains at a junction box, or by a three-prong electrical cord plugged into a receptacle. The strip is used with adapter plugs having an L-shaped power prong, an L-shaped neutral prong stepped back from the power prong, and a cylindrical ground prong. The prongs are inserted through the slot, the adapter plug is rotated 90° to align the prongs with the bus bars, and the adapter plug is drawn forward to engage the prongs with the bus bars. The location is fixed by threading a nut around the adapter plug body. In the preferred embodiment, the adapter plug has a three-prong polarized receptacle opposite the prongs. However, as an alternative, the adapter plug may be attached directly to an appliance cord or an extension cord.

The elongated strip permits positioning a receptacle or outlet at any desired location along the length of the strip. Moreover, each receptacle or outlet is polarized, and is also connected to ground so that it accepts appliances that require either a two-prong or three-prong plug connected to ground for safety purposes. Optionally, the power supply strip may have a built-in circuit breaker and/or a transient metal oxide varistor (MOV) for surge protection.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
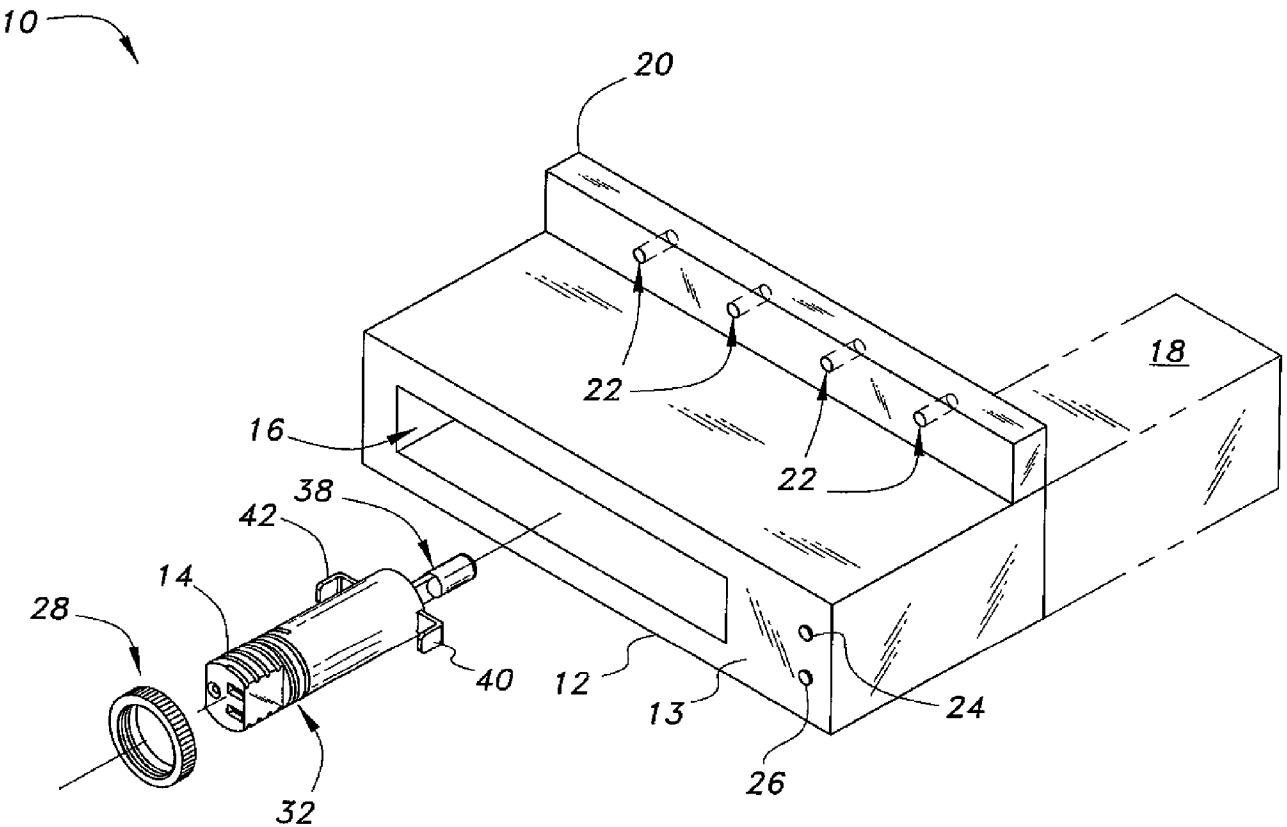
FIG. 1 is a perspective view of a power supply strip with repositionable outlets according to the present invention.

The power supply strip with repositionable outlets 10 includes an elongated housing 12 defining the strip. The housing 12 has a front face 13 defining an elongated rectangular slot 16. As shown in FIG. 1, the power supply strip with repositionable outlets 10 makes use of an adapter plug 14 that may be variably positioned at any location along the slot 16 defined by the strip housing 12, thus allowing an outlet for a conventional power cord or the like to be easily and variably located. As shown, the power supply strip 10 includes the power supply housing 12, which has slot 16 formed through a front face 13 thereof for receiving the adapter plug 14. As will be described in greater detail below, with particular reference to FIGS. 4A and 4B, upper and lower bus bars (power and neutral bus bars, respectively) 52, 54 are mounted within the power supply housing 12 and are in electrical communication with the AC power mains. A ground bus bar 50 is also mounted within the power supply housing 12, directly in line with the slot center line, for connection to ground. In FIG. 1, a conventional electrical system junction box 18 is shown for attaching the bus bars 50, 52, 54 to the AC power mains, although it should be understood that the power supply strip 10 may be plugged into a standard three-prong electrical receptacle by a conventional three-prong power cord to connect the bus bars 50, 52, 54 to the AC power mains.

Figure 2A:
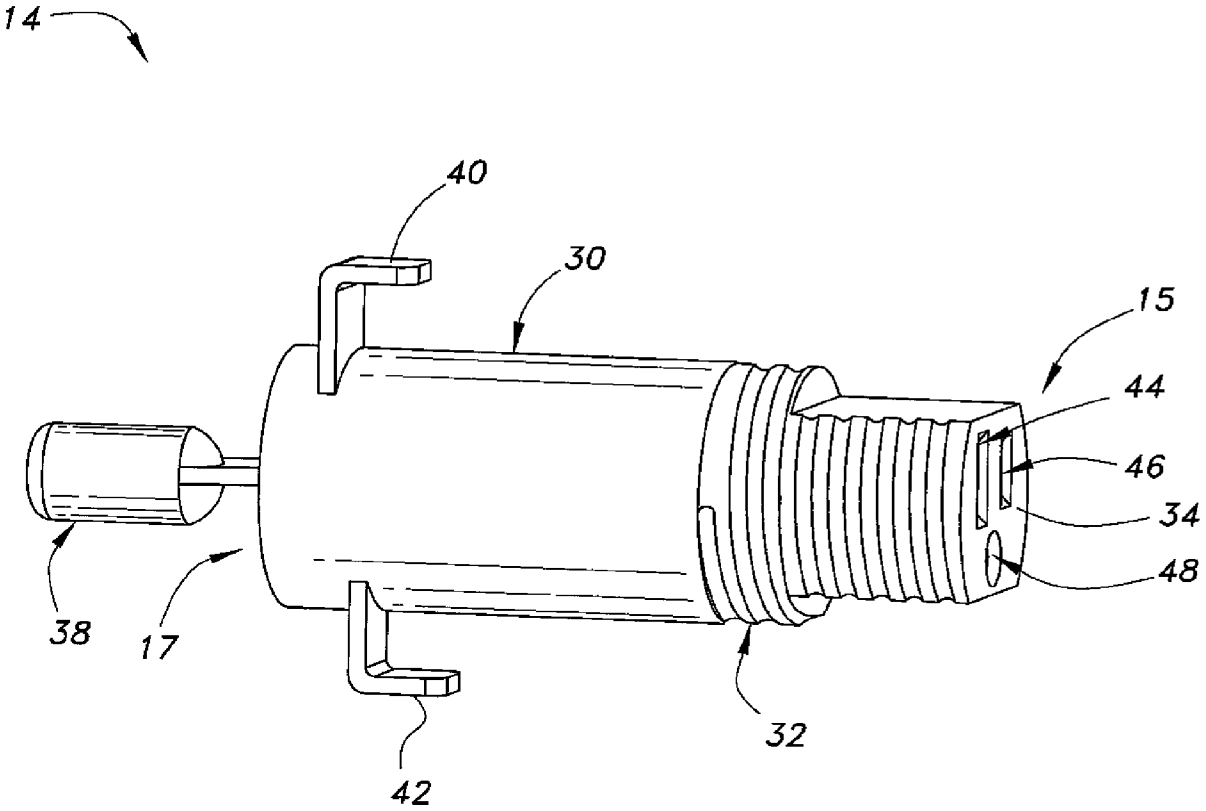
FIG. 2A is a perspective view of a first embodiment of an adapter plug for the power supply strip with repositionable outlets of FIG. 1.
Figure 2B:
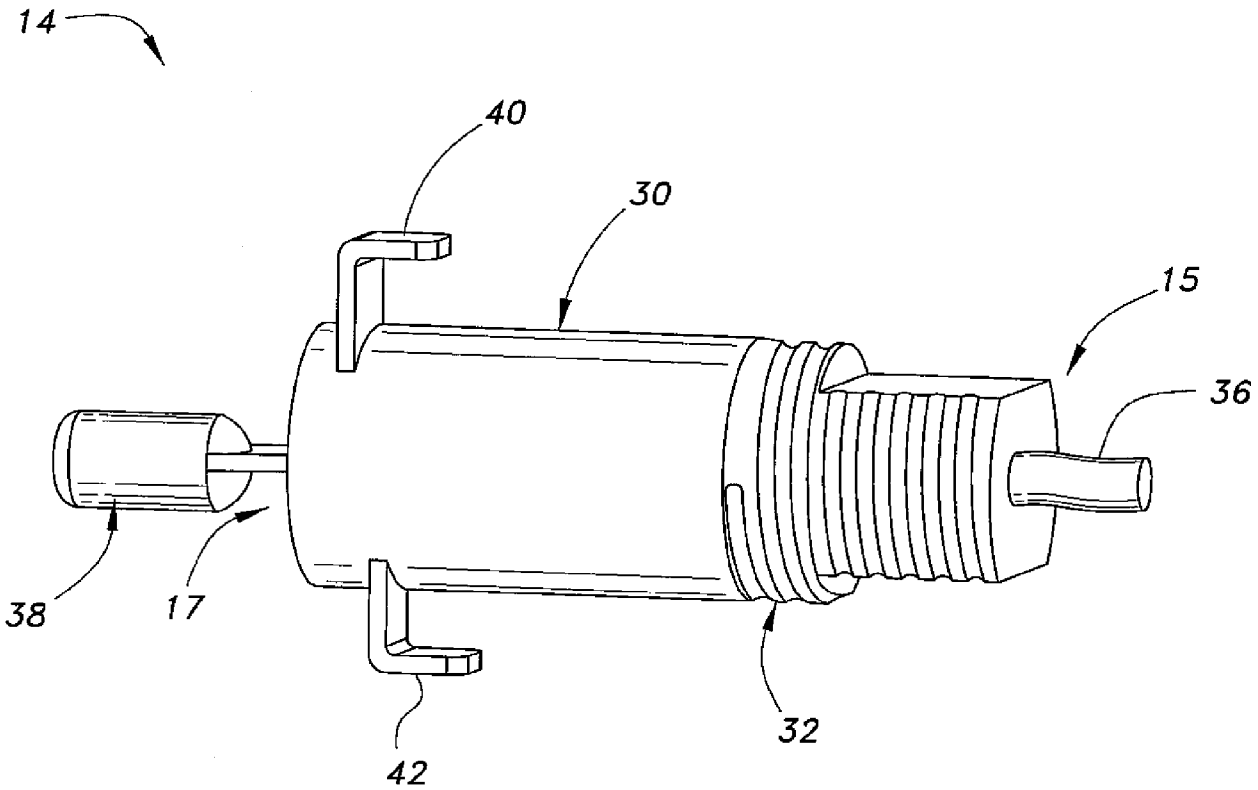
FIG. 2B is a perspective view of a second embodiment of an adapter plug for the power supply strip with repositionable outlets of FIG. 1.

The elongated power bus bar 52, the elongated neutral bus bar 54, and the elongated ground bus bar 50 extend the length of the housing in compartments above, below, and in the rear of the slot, respectively. As noted above, the bus bars 50, 52, 54 are in electrical communication with the AC power mains at a junction box, or by a three-prong electrical cord plugged into a receptacle. The strip 10 is used with adapter plugs 14, each having an L-shaped power prong 40, an L-shaped neutral prong 42 (positioned forward of the power prong 40, as best seen in FIG. 2A), and a cylindrical ground prong 38. The prongs 38, 40, 42 are inserted through the slot, and the adapter plug 14 is rotated 90° to align the prongs with the respective bus bars, and the adapter plug 14 is drawn forward to engage the prongs with the bus bars. As will be described in greater detail below, the location is fixed by threading a nut 28 around a forward, contact end of the adapter plug body. In the preferred embodiment, the adapter plug 14 has a three-prong polarized receptacle 34 opposite the prongs, as shown in FIG. 2A. However, as an alternative, the adapter plug 14 may be attached directly to an appliance cord or an extension cord, as shown in FIG. 2B and as will be discussed in greater detail below.

The elongated strip permits positioning of a receptacle or outlet at any desired location along the length of the strip. Moreover, each receptacle or outlet is polarized, and is also connected to ground so that it accepts appliances that require either a two-prong plug or a three-prong plug connected to ground for safety purposes. Optionally, the power supply strip may have a built-in circuit breaker and/or a transient metal oxide varistor (MOV) for surge protection.

It should be understood that the housing 12 may have any suitable overall relative dimensions, and is shown in FIG. 1 for exemplary purposes only. As shown, a flange 20 may be mounted on a rear end of housing 12, allowing for mounting to a wall or the like via screws inserted through holes 22, for example, or by any other suitable method. In FIG. 1, power supply housing 12 and slot 16 are shown as being substantially rectangular. The housing 12 may be manufactured from any suitable type of non-conducting material, such as plastic or the like. As will be described in greater detail below, both the interior and exterior of power supply housing are formed from non-conductive materials, with the exception of bus bars 50, 52, 54 and their associated wires or other electrical connections to the AC power mains.

As shown in FIG. 2A, the adapter plug 14 has opposite ends, 15, 17, respectively. The power prong 40 and the neutral prong 42 extend radially outward adjacent end 17 on opposite sides of the plug 14. Both prongs 40, 42 are recessed from the axial end 17, with neutral prong 42 being further recessed than prong 40 from the axial end 17 of the plug 14. The power prong 40 is adapted for making contact with the upper bus bar 52, which is connected to the hot wire in the junction box 18, and the neutral prong 42 is adapted for making contact with the lower bus bar 54, which is connected to the neutral wire in the junction box 18. The main body of adapter plug 14 is formed from a non-conductive material, such as plastic or the like, allowing the user to safely handle the removable outlet plug. As shown, the power prong 40 and the neutral prong 42 both have a substantially L-shaped configuration, including a leg extending radially outward from the adapter plug 14 and a leg normal thereto extending axially parallel to the plug 14. A ground prong with a cylindrical end portion 38 extends along the center axis of the plug 14 outward from the end 17 for selectively contacting the ground bus bar 50.

The end 15 of the adapter plug 14 is a conventional polarized three-prong electrical outlet 34 for receiving a conventional electrical two- or three-prong electrical appliance power cord, either polarized or non-polarized. As shown, conventional prong slots 44, 46 of the electrical outlet 34 are in electrical communication with prongs 40, 42. Similarly, ground receptacle 48 is in communication with the ground prong 38. Alternatively, as shown in FIG. 2B, an electrical cable 36 may be hard-wired to the end 15 of the adapter plug 14.

Figure 3A:
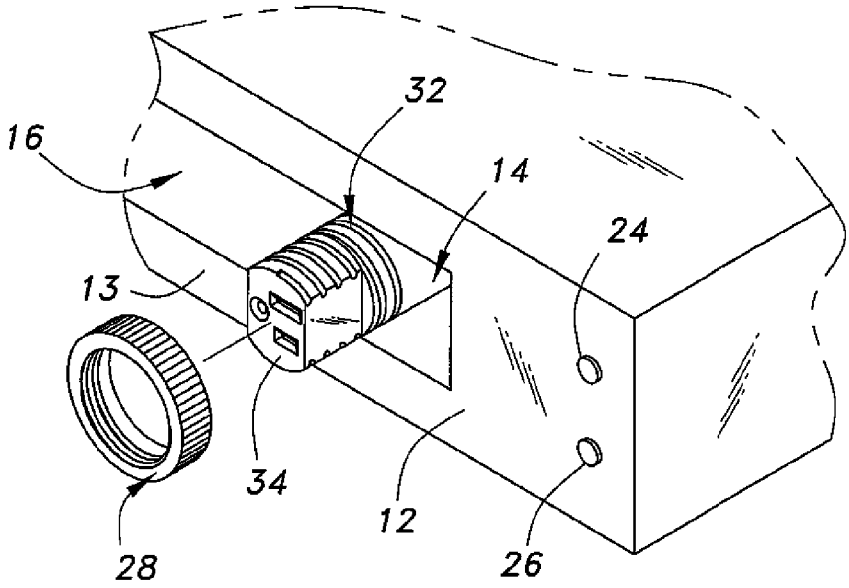
FIG. 3A is a partial perspective view illustrating partial insertion of the adapter plug of FIG. 2A into the slot of the power supply strip with repositionable outlets of FIG. 1.
Figure 3B:
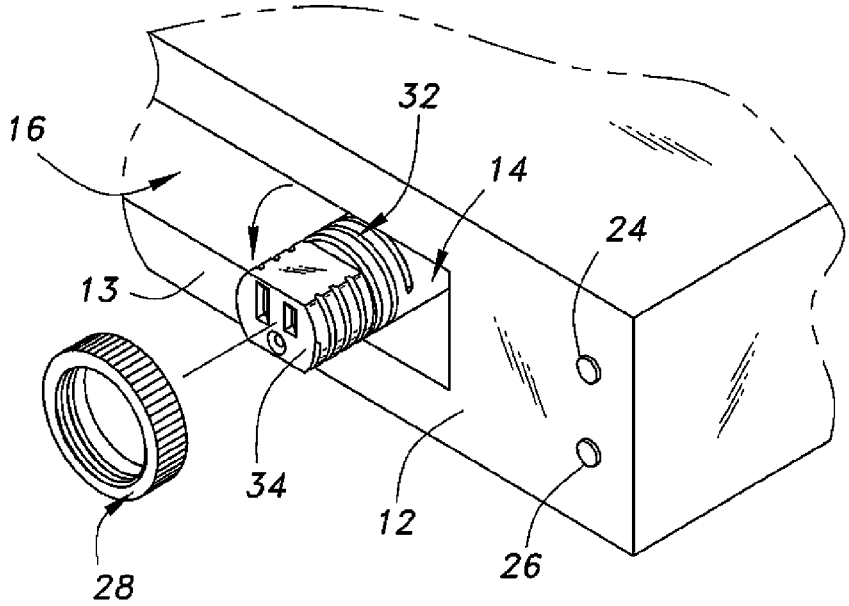
FIG. 3B is a partial perspective view illustrating adapter plug of FIG. 3A after rotation in the slot of the power supply strip with repositionable outlets of FIG. 1.
Figure 4A:
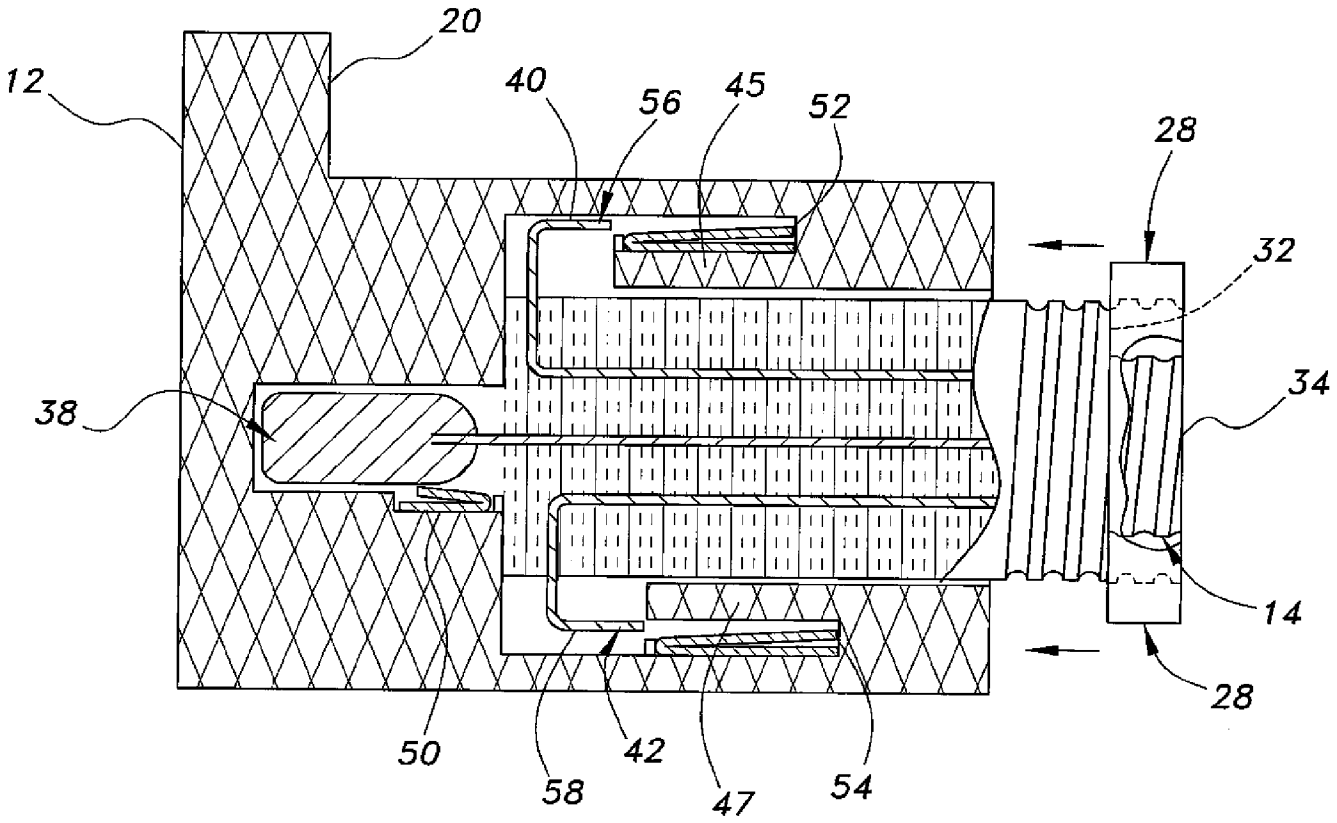
FIG. 4A is a side view in section of the power supply strip with repositionable outlets of FIG. 1, showing an adapter plug inserted to a maximum inward position and rotated in the slot of the strip, but in a first, non-contact position.
Figure 4B:
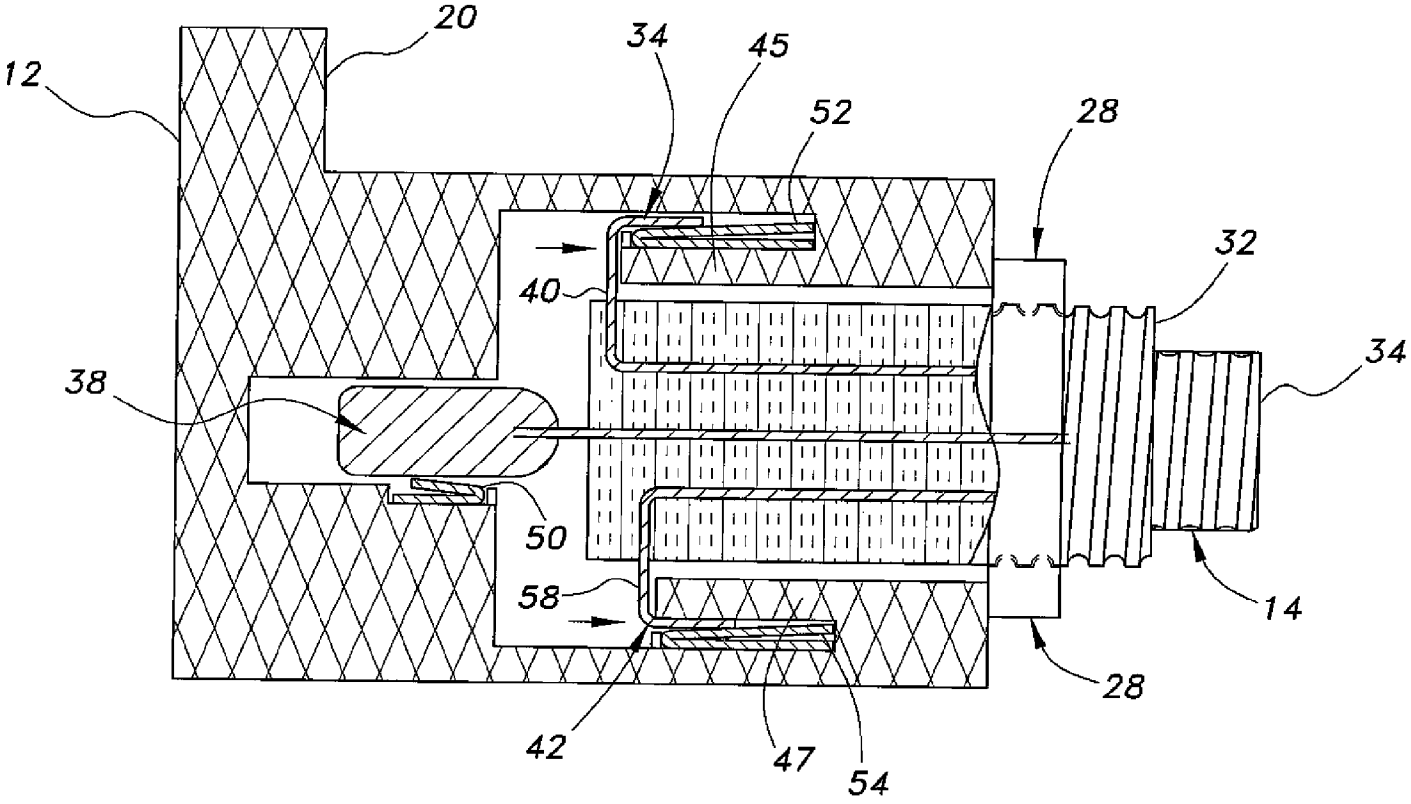
FIG. 4B is a side view in section of the power supply strip with repositionable outlets of FIG. 4A, showing the adapter plug after being pulled forward to a maximum outward position in its rotational configuration so that the prongs engage the bus bars.

In use, as shown in FIGS. 1 and 3A, the adapter plug 14 is selectively and removably inserted into the power supply housing 12 through the slot 16, such that the prongs 40, 42 are initially horizontal. Once the adapter plug 14 has been fully inserted within the power supply housing 12 (the positioning show in FIG. 3A), with the electrical outlet 34 or cable 36 positioned adjacent the front face 13 of the power supply housing 12, the adapter plug 14 is rotated 90° on its axis, as illustrated in FIG. 3B. The unequal axial positions of prongs 40 and 42 allow rotation of the plug 14 in one direction only. As a result, the power prong 40 and the neutral prong 42 are positioned opposite the upper bus bar 52 and the lower bus bar 54, as shown in FIG. 4A. The ground lead 38 is in contact with the ground bus bar 50 due to the initial insertion. Rotation of the plug 14 does not disturb contact due to the inline position of the plug axis and the slot centerline. In the position of FIG. 4A, the prongs 40 and 42 are still spaced apart from the bus bars 52 and 54, respectively. Thus, the adapter plug 14 is not energized at this point. It should be noted that there is a dual safety measure in using system 10; i.e., before adapter plug 14 is energized, the adapter plug 14 must first be rotated 90° to bring power prong 40 and neutral prong 42 adjacent upper bus bar 52 and lower bus bar 54, and then the adapter plug 14 must be pulled forward so that the prongs engage the bus bars. The ground prong length is sufficient for ground prong 38 to stay in contact with ground bus bar 50 when the plug 14 is pulled forward.

Although prongs 40, 42 may have any suitable relative dimensions, exemplary dimensions include a length of the horizontal lead portions 56, 58 of approximately 0.70 inches, a width of approximately 0.25 inches, and an overall thickness of the prongs 40, 42 of approximately 0.07 inches. The ground prong end portion (i.e., the contact portion) may have a diameter of approximately 0.20 inches, and the stem portion thereof may have a thickness of approximately 0.07 inches and a width of approximately 0.20 inches.

The adapter plug 14 is held in the engagement position and in place with respect to the front face 13 of the housing 12 via reception of a threaded nut 28 engaging a threaded portion 32 on the exterior of the adapter plug 14, as best seen in FIGS. 1, 2A and 2B. Tightening of the nut 28 clamps the adapter plug 14 against the housing 12 to fix the position of the outlet 34. In FIG. 1, the nut 28 is shown as being a cylindrical nut with a knurled outer surface. Although any suitable type of nut may be utilized, this particular type of nut, which may be tightened with the user's fingers, prevents damage to the device by usage of a hexagonal wrench or the like.

It should be noted that the power prong 40 is received within a relatively small space between an interior housing wall and the upper bus bar 52, which is mounted on wall 45. Using the exemplary dimensions given above, the bus bar 52 should be spaced apart from the housing wall by a height of approximately 0.07 inches. As shown, a similar wall 47 is provided on the lower interior of housing 12, with lower bus bar 54 being mounted on the lower housing wall with similar spacing for bus bar 54 and neutral prong 42. Since the neutral prong 42 is recessed further from the axial end 17 of the plug 14 than power prong 40, the neutral prong 42 cannot be rotated into position opposite the upper bus bar 52, as it will be blocked by wall 45. Thus, plug 14 maintains its polarization.

Figure 5:
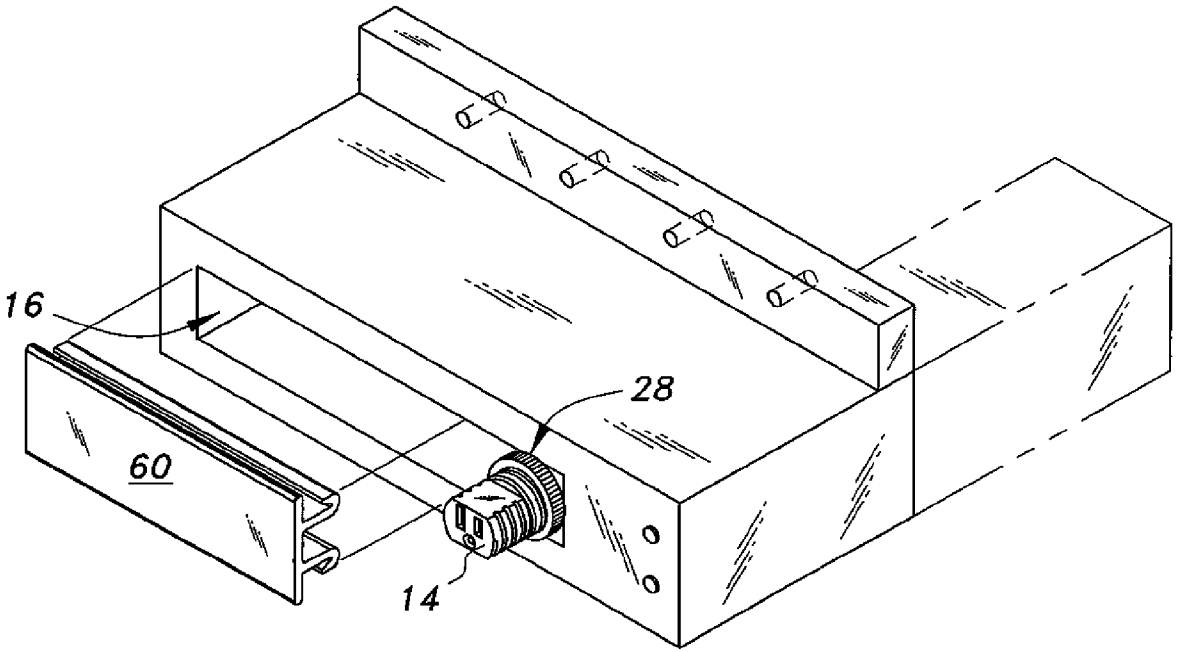
FIG. 5 is a perspective view of the power supply strip with repositionable outlets of FIG. 1, illustrating a removable cover thereof.
Figure 6:
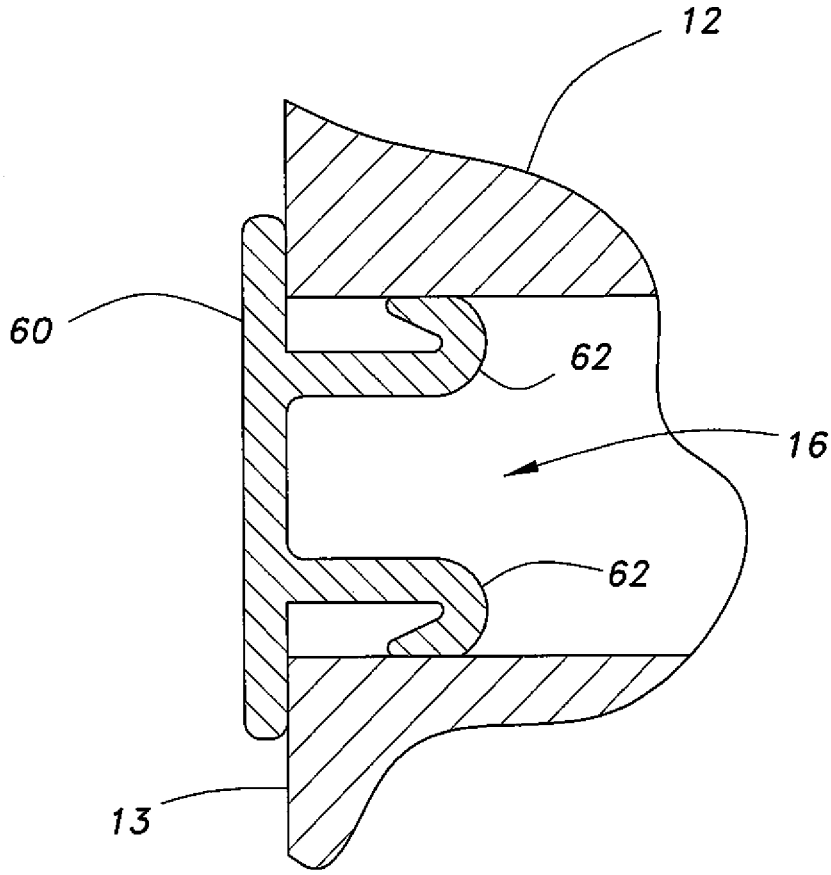
FIG. 6 is a partial side view in section of the power supply strip of FIG. 5, showing the removable cover installed in the slot.

As shown in FIGS. 5 and 6, a removable cover 60 may be provided for releasably covering and sealing the portion(s) of slot 16 that are not in use. As shown in FIG. 6, a pair of elastic tabs 62 may be provided for frictionally engaging the walls of housing 12 defining slot 16, although it should be understood that any suitable type of releasable fastener may be utilized. It should be understood that cover 60 is made of any suitable non-conductive material, such as plastic or the like, and may be manufactured or cut to a variety of different sizes, depending upon the needs of the user. Optionally, a circuit breaker and/or a surge protector may be built into the housing 12, which may have reset buttons 24, 26.

It is to be understood that the present invention is not limited to the embodiments described above, but encompasses any and all embodiments within the scope of the following claims.

I claim:

1. A power supply strip with repositionable outlets, comprising:

an elongated power strip housing having a front face defining an elongated rectangular slot, the housing defining upper and lower compartments above and below the slot and a central compartment in rear of the slot;

an elongated power bus bar disposed in the upper compartment;

an elongated neutral bus bar disposed in the lower compartment;

an elongated ground bus bar disposed in the central compartment; and an adapter plug having an elongated body having a load end adapted for connection to an electrical load and a contact end, the contact end having a power prong, a neutral prong, and a ground prong extending therefrom, the ground prong being cylindrical and extending axially away from the contact end, the power prong and the neutral prong being L-shaped blades, wherein the power prong and the neutral prong are insertable through the slot and the plug being rotatable to align the prongs with the power and neutral bus bars, the adapter plug being pulled forward to engage the prongs with the bus bars at any desired position along the slot.

2. The power supply strip with repositionable outlets as recited in claim 1, wherein said elongated power strip housing further comprises an upper flange adapted for releasable mounting to a wall surface.

3. The power supply strip with repositionable outlets as recited in claim 1, further comprising an elongated cover releasably covering at least a portion of the elongated rectangular slot.

4. The power supply strip with repositionable outlets as recited in claim 1, wherein the contact end of said adapter plug is substantially cylindrical, terminating in a rear face.

5. The power supply strip with repositionable outlets as recited in claim 4, wherein the power prong and the neutral prong are each positioned axially forward of the rear face of the contact end of said adapter plug.

6. The power supply strip with repositionable outlets as recited in claim 5, wherein the neutral prong is positioned axially forward of the power prong.

7. The power supply strip with repositionable outlets as recited in claim 1, wherein the adapter plug is selectively and releasably lockable within the housing.

8. The power supply strip with repositionable outlets as recited in claim 7, wherein the contact end of said adapter plug is at least partially threaded.

9. The power supply strip with repositionable outlets as recited in claim 8, further comprising a nut releasably engaging the at least partially threaded contact end of said adapter plug to secure said plug to said housing at any desired position along the slot.

10. A power supply strip with repositionable outlets, comprising:

an elongated power strip housing having a front face defining an elongated rectangular slot, the housing defining upper and lower compartments above and below the slot and a central compartment in rear of the slot;

an elongated power bus bar disposed in the upper compartment;

an elongated neutral bus bar disposed in the lower compartment;

an elongated ground bus bar disposed in the central compartment; and an adapter plug having an elongated body having a load end adapted for connection to an electrical load and a contact end, the contact end defining a rear face of the adapter plug and having a power prong, a neutral prong, and a ground prong extending therefrom, wherein the power prong and the neutral prong are each positioned axially forward of the rear face, the ground prong being cylindrical and extending axially away from the contact end, the power prong and the neutral prong being L-shaped blades, wherein the power prong and the neutral prong are insertable through the slot and the plug being rotatable to align the prongs with the power and neutral bus bars, the adapter plug being pulled forward to engage the prongs with the bus bars at any desired position along the slot.

11. The power supply strip with repositionable outlets as recited in claim 10, wherein the contact end of said adapter plug is substantially cylindrical, terminating in the rear face.

12. The power supply strip with repositionable outlets as recited in claim 10, wherein the neutral prong is positioned axially forward of the power prong.

13. The power supply strip with repositionable outlets as recited in claim 10, wherein said elongated power strip housing further comprises an upper flange adapted for releasable mounting to a wall surface.

14. The power supply strip with repositionable outlets as recited in claim 10, further comprising an elongated cover releasably covering at least a portion of the elongated rectangular slot.

15. The power supply strip with repositionable outlets as recited in claim 10, wherein the adapter plug is selectively and releasably lockable within the housing.

16. The power supply strip with repositionable outlets as recited in claim 15, wherein the contact end of said adapter plug is at least partially threaded.

17. The power supply strip with repositionable outlets as recited in claim 16, further comprising a nut releasably engaging the at least partially threaded contact end of said adapter plug to secure said plug to said housing at any desired position along the slot.

18. A power supply strip with repositionable outlets, comprising:

an elongated power strip housing having a front face defining an elongated rectangular slot, the housing defining upper and lower compartments above and below the slot and a central compartment in rear of the slot;

an elongated power bus bar disposed in the upper compartment;

an elongated neutral bus bar disposed in the lower compartment;

an elongated ground bus bar disposed in the central compartment; and an adapter plug having an elongated body having a load end adapted for connection to an electrical load and a contact end, the adapter plug being selectively and releasably lockable within the housing, the contact end defining a rear face of said adapter plug and having a power prong, a neutral prong, and a ground prong extending therefrom, wherein the power prong and the neutral prong are each positioned axially forward of the rear face, the ground prong being cylindrical and extending axially away from the contact end, the power prong and the neutral prong being L-shaped blades, wherein the power prong and the neutral prong are insertable through the slot and the plug being rotatable to align the prongs with the power and neutral bus bars, the adapter plug being pulled forward to engage the prongs with the bus bars at any desired position along the slot.

19. The power supply strip with repositionable outlets as recited in claim 18, wherein the contact end of said adapter plug is substantially cylindrical, terminating in the rear face, the neutral prong being positioned axially forward of the power prong.

20. The power supply strip with repositionable outlets as recited in claim 19, further comprising a nut, wherein the contact end of said adapter plug is at least partially threaded, the nut releasably engaging the threaded contact end to secure said plug to said housing at any desired location along the slot.

* * * * *